United States Patent [19]

Rheinlander et al.

[11] 3,934,755

[45] Jan. 27, 1976

[54] METHOD AND DEVICE FOR PREVENTING SLAG FROM ESCAPING WHEN EMPTYING A POURING VESSEL

[75] Inventors: Paul Rheinlander; Heinz Voigt, both of Wolfenbuttel, Germany

[73] Assignee: Thermo-Industrie GmbH & Co. KG, Bruchtorwall, Germany

[22] Filed: Apr. 3, 1974

[21] Appl. No.: 457,630

[30] Foreign Application Priority Data

Apr. 4, 1973 Germany ..... 2316757

[52] U.S. Cl. ..... 222/1; 164/134; 222/545; 266/38

[51] Int. Cl.[2] ..... B22D 37/00; B22D 41/10

[58] Field of Search ..... 266/38, 34 T; 164/134, 164/281, 337; 222/481, 509, 559, 1, DIG. 1, DIG. 3, DIG. 5, 545, 547

[56] References Cited

UNITED STATES PATENTS

| | | | |
|---|---|---|---|
| 967,012 | 8/1910 | Grasche | 164/134 X |
| 3,814,405 | 6/1974 | Ormaechea | 266/34 T |

FOREIGN PATENTS OR APPLICATIONS

| | | | |
|---|---|---|---|
| 4,515,482 | 3/1970 | Japan | 222/559 |

*Primary Examiner*—Robert B. Reeves
*Assistant Examiner*—David A. Scherbel
*Attorney, Agent, or Firm*—Wälter Becker

[57] ABSTRACT

A method of preventing slag from escaping when emptying a pouring vessel with a bottom outlet. The vessel contains steel and slag. During the end phase of the emptying of the pouring vessel, between the discharge opening and the interior space of the vessel a barrier of liquid steel is built up by passing the steel through a system of communicating flow paths surrounding the discharge opening. Thus the steel is caused with the remainder of its content in the vessel prior to the discharge of this remainder from the vessel, due to its greater specific weight automatically to prevent the lighter slag from entering the system and to reach the discharge opening. The vessel for practicing the above mentioned method has its discharge opening surrounded by a groove-shaped recess, the lowermost portion of which is located below the level of the upper edge of the discharge opening. A wall annularly extends from above into the recess without contacting the lowermost portion of the recess.

12 Claims, 4 Drawing Figures

Figure 1:
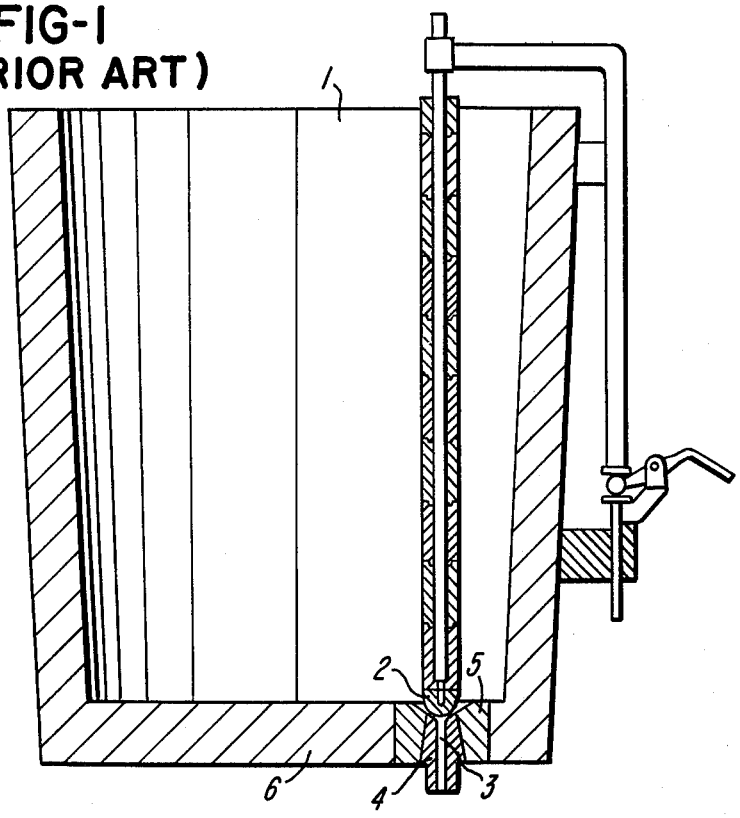
FIG-1 (PRIOR ART)

METHOD AND DEVICE FOR PREVENTING SLAG FROM ESCAPING WHEN EMPTYING A POURING VESSEL

The present invention relates to a method of preventing the escape of slag when emptying a pouring vessel which has a discharge opening in its bottom and contains steel and slag in liquid form. The invention also concerns a device, namely, a pouring vessel for carrying out the above mentioned method.

When emptying a pouring vessel containing a liquid steel and a liquid slag, the slag should be retained if possible completely because it has a harmful effect upon the later steel producing process. Its oxygen content increases the melting loss of alloy elements and of such additions which serve for deoxidization as, for instance, aluminum, manganese, and silicon. When the slag contains phosphorous, a return of phosphorous into the steel might occur. Furthermore, the slag increases the wear of refractory material. When casting steel in continuous casting machines, slag entering the ingot mold may deposit between the mold and the billet or casting. Due to the poor heat conductivity of the slag, it impedes the cooling of the steel so that breakouts may form. Therefore, with increasing employment of continuous casting machines in the steel industry, particular attention has to be paid to the problem of possibly completely retaining the slag when emptying a pouring or casting vessel.

It has become known when pouring from a converter with a tap hole to provide a float with a guiding bar above the tap hole. The specific weight of the float is to be greater than that of the slag and is supposed to be less than that of the steel so that after the steel has left the vessel, the float will seat upon and close the tap hole thereby retaining the slag. In order to be able also with a vessel having an outlet in the bottom and having a stopper closing system, for instance, of an ordinary casting ladle, to retain the slag completely while the steel leaves the vessel in the form of a jet, it has been suggested to provide an annular float with a specific weight between that of steel and slag by means of which the stopper bar is guided. This float floats on the steel and is, during the emptying of the vessel, moving downwardly until it rests on the bottom and blocks the path for the slag toward the outlet.

These known floats have the drawback that they are greatly attacked by the slag. Therefore, special devices have been provided which bring about that the float will only at the end of the pouring out of the bath rest upon the outlet and contact the slag. The erosion of the discharge of stone and of the float affect the seal between said stone and said float when the float has seated on the bottom so that depending on the extent of erosion, still some slag can escape.

There has furthermore become known a method of producing cast steel with a high degree of purity, according to which the steel will, during the pouring enter an intermediate container where it intermixes with cleaning slag. To this end, the steel is by a specific design of the intermediate container forced into a flow path which brings the steel into intensive contact with the cleaning slag. The design may be such that the steel first passes below a partition in the intermediate container and then has to flow over a dam at the bottom of the container, in other words, has to flow along a path designed in conformity with the principle of intercommunicating tubes. The upward flow in the vessel or container to the purifying slag as created in this manner will see to it that also fine impurities which rise only under difficulties are brought into contact with the slag. The escape of the slag during the emptying of the intermediate container, however, is not prevented in this way.

Similarly, it has been suggested to provide transverse webs in a distributing device for pouring quieted-down steel. The transverse webs bring about a repeated upward flow of the steel in the direction toward the slag thereabove so that a cleaning effect will be obtained. The escape of the slag during the emptying of the device has to be prevented by other means.

Finally, it has become known to provide a collecting vessel for liquid metal in which a metallurgical influence is exerted by a slag former. To this end, the vessel is provided with an antechamber, and the transfer from this chamber to the collecting vessel is provided with a siphon which prevents the slag from entering the collecting vessel. In order to be able also when tilting the vessel for purposes of emptying the same, to prevent the slag from flowing from the antechamber into the vessel, the siphon may be supplemented by a wall arranged in the collecting vessel behind the transfer section. The problem of preventing the slag from escaping with vessels having a discharge in the bottom does not occur in this connection.

It is therefore an object of the present invention to provide a method and device for preventing slag from escaping when emptying a pouring vessel containing steel and slag, which will overcome the above mentioned drawback and will be free from the defects inherent to the employment of a float as encountered with heretofore known devices.

These and other objects and advantages of the invention will appear more clearly from the following specification, in connection with the accompanying drawings, in which:

FIG. 1 diagrammatically illustrates a longitudinal section through a casting ladle with bottom discharge of the prior art.

Figure 2:
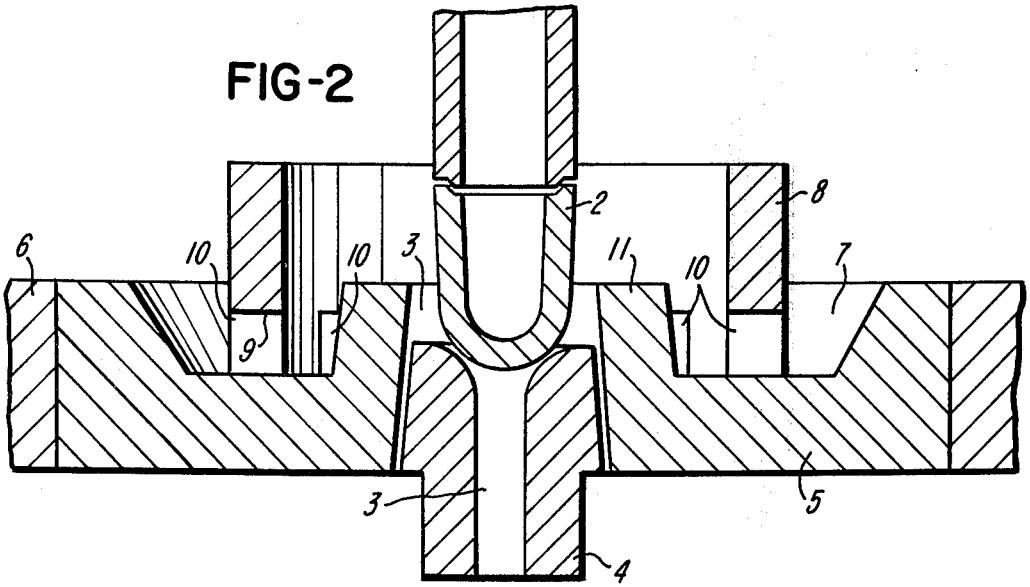

FIG. 2 illustrates on a larger scale than that of FIG. 1, a bottom outlet in a pouring vessel according to the invention.

Figure 3:
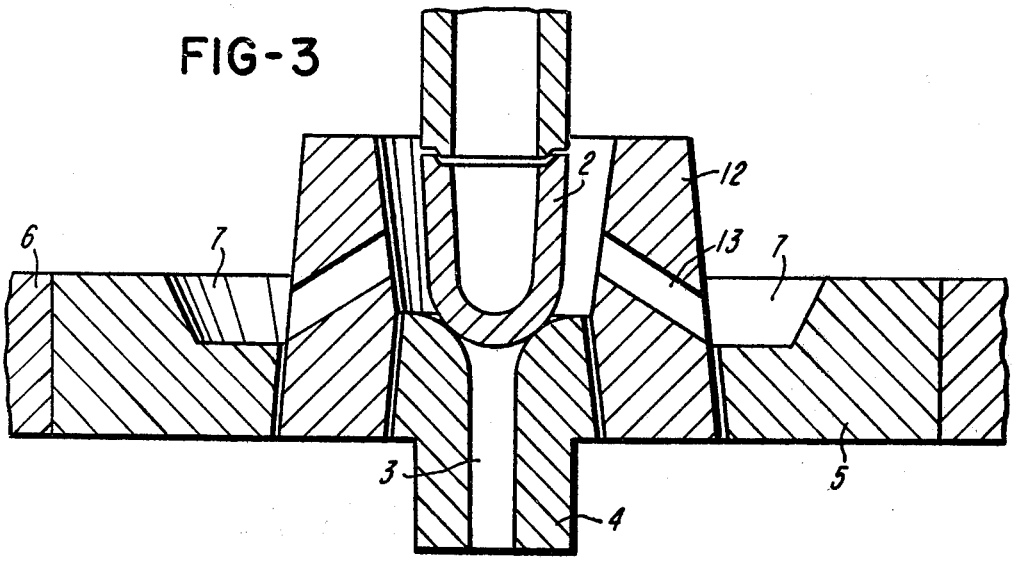

FIG. 3 likewise illustrates on a scale larger than that of FIG. 1, a second embodiment of a device according to the invention.

Figure 4:
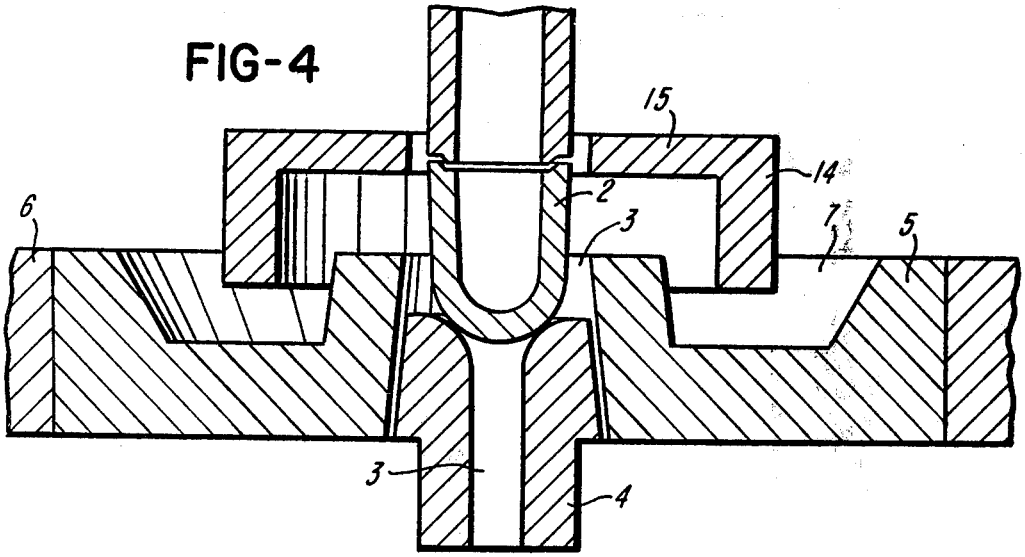

FIG. 4 illustrates, similar to FIGS. 2 and 3, a third embodiment of the device according to the invention.

The method according to the present invention is characterized primarily in that during the end phase of the emptying of the pouring vessel, between the emptying opening and the interior of the vessel there will be built up a barrier of liquid steel by the steel passing through a system which surrounds the emptying or discharge opening and is designed in the manner of communicating flow paths whereby the steel will be caused automatically together with the remainder of the content of the vessel prior to leaving the bottom of the vessel, due to its greater specific weight, to prevent the lighter slag from advancing into said system to the discharge opening. Such an arrangement brings about the advantage that for purposes of retaining the slag, no specific structural element has to be inserted into the pouring vessel, nor any corresponding tool. The retaining of the slag is effected by the steel itself, and more specifically, automatically, in view of the emptying process. In addition to a great saving, above all a simplification of the method is realized due to the fact that the operator does not have to pay the heretofore necessary careful attention during the pouring operation.

A pouring ladle for practicing the method according to the invention is characterized primarily in that the discharge opening of the pouring vessel is surrounded by a groove-shaped recess, the deepest section of which is located below the level of the upper edge of the discharge opening. The pouring ladle according to the invention is furthermore characterized by a wall which annularly extends from above into said recess without contacting the deepest bottom portion of the recess. According to one embodiment of the invention, the recess may also comprise the radial extension of the bottom of the vessel.

A preferred embodiment of the invention consists in that the wall is designed as an annular bottom which rests upon the lowermost portion of the recess where it is provided with perforations which are located at a level lower than the depth of the recess. The extent to which the effective bottom edge of the wall extends into said recess should be at least half as much as the largest possible thickness of the slag. The wall with its perforations may form a part of the recess itself.

Referring now to the drawings in detail, the pouring ladle 1 illustrated in FIG. 1 is adapted to be opened and closed by an upward and downward movement respectively of a stopper which controls the discharge opening 3 in the discharge stone 4. The discharge stone 4 is arranged in the perforated brick 5 which forms a part of the fire resisting ladle bottom 6.

In FIG. 2, the stopper 2, the discharge stone 4, and the perforated brick 5, have the above described function. In order to realize a complete closure of the outlet when the level of the steel has dropped to that of the ladle bottom 6, an annular recess or groove 7 is provided in the perforated brick 5. This annular recess extends around the discharge stone 4. An annular wall 8 is immersed into the recess 7 and is connected to the bottom of the recess 7 in any convenient manner. However, between the bottom of recess 7 and edge portions 9 of the wall 8, openings 10 are defined which are distributed over the entire circumference.

When opening the stopper 2, a portion of the steel jet flows through the annular chamber between stopper 2 and wall 8 while the major quantity of steel will with a corresponding dimensioning of the cross sections passed through flows through the recess 7 below the immersed wall 8 and then rises again, flows over the inner portion 11 of the recess 7 into the discharge stone 4 with the discharge opening 3. When the steel has flown out from the ladle 1 to such an extent that its upper level is substantially flush with the upper edge of wall 8, the steel merely flows through the recess 7 and the openings 10 to the discharge stone 4. If the steel level now drops further down to the ladle bottom 6, the flowing through stops. The slag on the steel cannot follow because the steel provided in the recess 7 forms a barrier and blocks the way for the slag. The steel still drops slightly outside the wall 8 due to the weight of the slag pressing thereon. The slag, however, cannot flow through as long as it has not reached the edge of wall 8.

When the slag layer has, for instance, a thickness 10 centimeters, at a ratio of the specific weight of the steel to the slag of 2:1, the level of the steel will drop outside the annular wall 8 by approximately 5 centimeters, which means that the spacing between the lower edge 9 of wall 8 on one hand, and the upper edge of part 11 on the other hand, must at least be half as much as the thickness of the greatest possible slag layer. Under these circumstances, an escape of the slag will be safely prevented.

FIG. 3 illustrates an embodiment which is particularly well suited for larger pouring ladles. The reference numerals 2 – 7 designate the same elements as in FIGS. 1 and 2. Around the discharge stone 4 there is provided a separate ring 12. This ring is, for instance, connected to the perforated stone 5 by means of a bayonet joint. The outlet stone 4 is again connected to the ring 12, for instance, by a bayonet joint. The ring 12 forms the inner wall of the recess 7. Similar to the arrangement of FIG. 2, an annular wall may be inserted into the recess 7. However, it is simpler to provide the ring 12 with openings 13 in the form of passages which lead from the bottom of the recess 7 in upward direction. This ring 12 with the openings 13 will then have the same barrier effect as the wall 8 of FIG. 2 described above. The openings 13 may extend over the entire circumference of ring 12 and may be interrupted only by the supports which interconnect the upper and lower portion of ring 12. The cross section of the openings 13 should be considerably greater than that of the discharge opening 3. The greater this cross section is, the smaller will be the flow-through velocity and the erosion of ring 12 and the stones which surround the stopper bar 2, and the less will also be the danger that the steel freezes in the cold ladle at the start of the pouring of steel into said ladle.

In order to reduce the exit speed in the interior of ring 12, the cross section of the openings 13 may be increased in the direction from the outside toward the inside. The lateral walls of the openings 13 may extend in radial direction. However, they may also extend in such a way that in the space between the inner wall of ring 12 and the lining of the stopper bar 2, a circulating movement of the steel is brought about by means of which slag particles which might have entered this space will be centrifuged away beyond the upper edge of the ring 12. The height of the ring 12 is determined by the size of the ladle and by the steel quality and the required degree of purity. When the ring has a great height, it may be expedient to form the upper portion of the ring cylindrical. It depends on the quality and the machining possibility of the fire-resistant stone material whether the ring 12 and the discharge stone 4, as shown in FIG. 3, is inserted in the form of two separate pieces or whether already during the manufacturing process both are combined to one piece.

According to a further embodiment of the invention, the recess 7 (FIG. 3) may be entirely discarded when the openings 13 in ring 12 extend to the bottom 6 of the ladle 1. The quantity of steel retained in the ladle will in such an instance, however, be somewhat greater and will fill the entire surface of the ladle at a level which is determined by the lower edge of the openings 13 on the inner wall of ring 12. It will have to be determined from case to case whether this simple construction without recess 7 and with higher steel losses is to be selected, or whether the embodiment illustrated in FIG. 3 with lower steel losses is to be preferred.

FIG. 4 shows an embodiment which operates with floats, known per se. The reference numerals 2 – 7 indicate corresponding elements shown in FIG. 1. During the discharge of the last remnants of the steel, the lower end 14 of a bushing-shaped float 15 immerses into the recess 7 where it brings about a liquid closure similar to the wall 8 in the embodiment of FIG. 2. The advantage of this float arrangement over heretofore known float arrangements consists in that the liquid flows will be tight also when the perforated stone 4 and the lower end 14 of the float 15 has been strongly corroded by the slag.

The above outlined embodiments according to the invention relate to ladles with a stopper closure by the method of the invention may also be applied to other vessels. A considerable simplification is obtained if the stopper is replaced by a slide closure. The ring 12 (FIG. 3) is, in such an instance, closed at the top by a cover or stopper so that the entire steel must flow through the openings 13.

The embodiments according to FIGS. 2 and 3 have, over the embodiment of FIG. 4 with float, the advantage that only parts which are fixedly connected to the vessel are used for retaining the slag. These parts may be installed when exchanging the discharge stone 5 in the manner customary in metallurgy.

The method according to the invention can in technical analogy be applied to all methods according to which two liquids of different specific weight are to be separate from each other when being emptied from one and the same vessel.

It is, of course, to be understood that the present invention is, by no means, limited to the specific showing in the drawings, but also comprises any modifications within the scope of the appended claims.

What we claim is:

1. A method for preventing relatively lighter slag from escaping when emptying a pouring vessel containing steel of a specific weight heavier than that of slag and the relatively lighter slag in liquid form and provided with a stopper operated discharge opening in the bottom of the vessel, which includes in combination therewith the steps of providing a means for maintaining a barrier of heavier liquid steel between the relatively lighter slag and the discharge opening during the end phase of the vessel emptying operation and allowing said means to shutoff the flow of steel through the discharge opening while maintaining the barrier of steel between the slag and discharge opening.

2. A pouring vessel adapted to receive liquid steel of a specific weight heavier than that of slag and relatively lighter slag, which includes: a bottom with a discharge opening therein, annular trough means extending around said discharge opening and having its deepest surface area located at a level lower than the level of the upper edge of said discharge opening, and tubular wall means entering said trough means from the interior of said vessel and at least partially defining passage means leading from the deepest surface area of said trough means for keeping heavier steel as a barrier up to a level at least as high as the level of the upper edge of said trough means to prevent relatively lighter slag from reaching said discharge opening.

3. A pouring vessel adapted to receive liquid steel and slag, which includes: a bottom with a discharge opening therein, annular trough means extending around said discharge opening and having its deepest surface area located at a level lower than the level of the upper edge of said discharge opening, and tubular wall means entering said trough means from the interior of said vessel and at least partially defining passage means leading from the deepest surface area of said trough means to a level at least as high as the level of the upper edge of said trough means, said tubular wall means having portions of its lower edge in spaced relationship to said deepest surface area of said trough means, so as to define openings therewith.

4. A pouring vessel according to claim 3, in which said trough means extends in radial direction with regard to said vessel bottom.

5. A pouring vessel according to claim 4, in which the lower edge portion of said wall means extends into said trough means by at least half the depth of the maximum possible slag thickness to be expected.

6. A pouring vessel according to claim 3, in which said tubular wall means forms an annular body resting on the deepest surface area of said trough means.

7. A pouring vessel according to claim 3, in which said trough means are provided in a vessel bottom portion of perforated brick.

8. A pouring vessel according to claim 3, in which said tubular wall means has the shape of an inverted cup with a central passage in the bottom of said cup.

9. A pouring vessel according to claim 3, in which said tubular wall means is designed as a floating body.

10. A pouring vessel adapted to receive liquid steel and slag, which includes: a bottom with a discharge opening therein, annular trough means extending around said discharge opening and having its deepest surface area located at a level lower than the level of the upper edge of said discharge opening, and tubular wall means entering said trough means from the interior of said vessel and at least partially defining passage means leading from the deepest surface area of said trough means to a level at least as high as the level of the upper edge of said trough means, said wall means being provided with openings therethrough leading from said trough means to a level higher than the upper edge of said trough means.

11. A pouring vessel adapted to receive liquid steel and slag, which includes: a bottom with a discharge opening therein, annular trough means extending around said discharge opening and having its deepest surface area located at a level lower than the level of the upper edge of said discharge opening, and tubular wall means entering said trough means from the interior of said vessel and at least partially defining passage means leading from the deepest surface area of said trough means to a level at least as high as the level of the upper edge of said trough means, said trough means being provided in a vessel bottom portion of perforated brick, said wall means forming a portion of said perforated brick, and said conduit means extending radially while extending from the lower most portion of said trough means to a level at least as high as the level of the upper edge of said trough means.

12. A pouring vessel according to claim 11, in which the cross section of said conduits increases in the ascending direction.

* * * * *